United States Patent [19]

Raymond

[11] 4,082,869

[45] Apr. 4, 1978

[54] SEMI-HOT METALLIC EXTRUSION-COATING METHOD

[76] Inventor: Anthony J. Raymond, 20429 Attica Rd., Olympia Fields, Ill. 60461

[21] Appl. No.: 703,532

[22] Filed: Jul. 8, 1976

[51] Int. Cl.[2] ..... B05D 1/00; B05C 3/04

[52] U.S. Cl. ..... 427/357; 118/65; 118/69; 118/405; 164/419; 427/370; 427/374 C; 427/431; 427/432; 427/433

[58] Field of Search ..... 118/404, 64, 65, 69, 118/405, DIG. 11, DIG. 18, 125; 427/61, 117, 118, 120, 357, 383, 404–406, 380, 367, 374, 356, 358, 369, 370, 431–433; 164/86, 275

[56] References Cited

U.S. PATENT DOCUMENTS

| | | | |
|---|---|---|---|
| 310,994 | 1/1885 | Farmer | 118/DIG. 18 |
| 443,536 | 12/1890 | Norman | 164/275 X |
| 910,674 | 1/1909 | Hancock | 164/86 |
| 1,811,505 | 6/1931 | Kennedy | 118/DIG. 18 |
| 2,216,519 | 10/1940 | Quarnstrom | 427/431 X |
| 3,285,224 | 11/1966 | Reser | 118/405 |
| 3,666,537 | 5/1972 | Williams | 427/432 X |
| 3,696,503 | 10/1972 | Krengel et al. | 427/432 X |

FOREIGN PATENT DOCUMENTS

| | | | |
|---|---|---|---|
| 971,086 | 12/1958 | Germany | 118/125 |

*Primary Examiner*—Morris Kaplan
*Attorney, Agent, or Firm*—Robert L. Lindgren; Edward D. Gilhooly; Davis Chin

[57] ABSTRACT

A method and apparatus for use in continuously applying molten coating metal, such as in galvanizing or aluminizing to tubes, rods, wire or other work pieces passing through a metallic bath. The molten metal in a reservoir is discharged onto the tube or rod, the metal flowing around the tube or rod being controlled by a splash tube. The coating metal is progressively agitated and cooled within the splash tube, after which the tubing or rod is accurately centered to exit the splash tube with an even coating of the desired thickness, such coating being in a stable condition. The entire system is enclosed in an inert atmosphere eliminating the formation of "galvanizers' dross", oxides of aluminum, etc.

9 Claims, 6 Drawing Figures

SEMI-HOT METALLIC EXTRUSION-COATING METHOD

BACKGROUND OF THE INVENTION

In the art of hot metallic coating of steel tubes by the application of molten zinc or aluminum, one of the problems which exists is the surrounding of the tube with the coating material without the tube being bent to pass through a molten metal bath as has been customary when coating continuous lengths of wire or strip.

It will be realized that in the coating of wires or strips no problem exists as the wire or strip can be bent by passing it over guide rollers to extend down into the molten metal bath and can then be guided along the bath and taken out of the bath at the other end by again passing around appropriately positioned guide rollers. When it is necessary to coat tubing or larger rods or members which cannot be bent, and which have a length such that they cannot be submerged in the bath, the method used for coating is to pass the products through a trough which had closed ends and sides into which the coating liquid is pumped. The trough has apertures in its ends so that the tube can pass into the trough at one end and out at the other with a minimal spill of coating fluid through the apertures.

Processes of the type described are used particularly in the continuous formation of tubes which are then galvanized and cut into lengths. The tubes are formed from flat strip passed through forming guides and bent to tubular form. The joint is then welded to give a continuous tube, means being used to cut off any projecting metal at the weld. The tube is then usually heated by induction in an inert atmosphere and is passed into the galvanizing section in which the trough is positioned above the level of the molten zinc in the kettle. This section is usually also maintained in an inert atmosphere by enclosing the top of the kettle and the trough. On leaving the trough, excess zinc is removed from the tube by means of an air knife or the like surrounding the tube. The excess zinc flows back into the kettle. The tube passes out of this zone to a flying shear which cuts the galvanized tubing to length.

The present invention relates generally to this type of process but is not necessarily limited thereto as it can be applied anywhere where tube or conduit or rod or the like, which will generally be referred to as a "work piece", is required to be continuously passed through a metal coating zone while maintaining linear alignment of the work piece being coated.

Certain objections exist to the use of a trough which has ends and sides and has sealed apertures through which the work piece to be treated must pass. One difficulty is to obtain optimum size of the apertures in relation to the work piece to ensure that, especially at the exit end, the coat of galvanizing material which has been applied to the work piece will not be disturbed or adversely affected. More significantly perhaps, the seals are responsible for wiping the work piece such that the amount of coating matal remaining (0.8 ounces/ft$^2$ at best) is far less than the prescribed optimum, considered as 1 – 1¼ ounces/ft$^2$.

A further problem exists in that it is necessary to supply sufficient zinc to the trough to cause the level to be maintained well above the work piece, and to maintain a sufficient flow by pumping excess zinc to the trough to ensure that the level will be maintained and also to ensure that there will be a correct temperature gradient over all parts of the trough for most effective galvanizing.

These and other problems were overcome by my previous inventions as described in U.S. Pat. No. 3,877,975 and U.S. Pat. No. 3,956,537. However, a further problem which exists in processes such as those mentioned above is the continuous formation of "galvanizer's dross" in the case of galvanizing and an aluminum oxide in the case of aluminizing. It has been general practice to enclose the bath as much as possible in an inert atmosphere to prevent the formation of galvanizers dross or aluminum oxide. In the case of galvanizing the dross can appear in three different forms, namely aluminum zinc oxide, iron zinc oxide and an iron zinc alloy. The majority of the iron zinc alloy can be eliminated by replacing the conventional iron kettle with a refractory lined induction heated furnace, and metalizing the other parts of the process which come in contact with the molten metal with a material not wetted by zinc such as molybdenum. In the case of aluminizing, as molten aluminum and iron are incompatible with the aluminum dissolving the iron at a rapid rate, use of the refractory lined furnace is imperative. Aluminum shows no reaction with refractories. These and other techniques were set forth in a technical paper entitled, "Remodeling the In Line Galvanizing Process", which was presented to The Association of Iron and Steel Engineers on May 4, 1976 in Birmingham, Alabama. The oxides, however, are formed through aeration of the molten metal by the air knife, by the excess coating metal falling from the work piece to the main supply and by the exposure to the air of the exit end of the furnace from the purpose of collecting the excess coating metal from the work piece, and the air knife.

Another problem, which exists in processes mentioned above, is the inability to obtain an evenly distributed coating about the periphery of the work piece through the use of an air knife. The force of gravity tends to allow the coating to sag, resulting in a thicker coating about the lower sides and bottom, and a thinner coating on the top and upper sides of the work piece before it enters the air knife for freezing.

These latter deficiencies and other problems are overcome by the present invention.

SUMMARY OF THE INVENTION

The process according to the present disclosure consists of flowing the molten metal (e.g. galvanizing or aluminizing material) over the work piece from a reservoir while using a splash plate in the form of a tube to direct the flow around the work piece in the most effective manner.

The splash tube is connected to the reservoir to receive the molten coating material from slots or apertures in the reservoir. The space between the splash tube, and the work piece can be relatively narrow so as to reduce the necessary supply of coating fluid replenished from the reservoir.

The hot molten metal, which may be zinc, aluminum or zinc with an additive such as aluminum or other metals, flows from the reservoir where it is maintained at the correct temperature by heating means, and into which it is pumped from a molten metal furnace in regulated quantities. Molten metal flows from the bottom of the reservoir over the work piece as it moves in a straight line beneath the reservoir. To control the flow around the work piece, the splash tube is used to ensure that the work piece is completely surrounded by the coating fluid. Since the splash tube can be spaced a short distance from the work piece, longitudinal flow can be induced in the coating medium and controlled in its direction by shaping of the splash tube.

The apertures in the reservoir through which the flow takes place on to the work piece can be variously positioned and can be of different shapes.

In order to assure a coating thickness of the desired dimension and to prevent aeration of molten metal, among other things, the splash tube has a smooth bore from the entry side to just beyond the last aperture in the reservoir, allowing a free flow of metal back to the main supply, which is under an inert atmosphere. Beyond the last aperture, the inside of the splash tube is equipped with a series of spiral or helical ribs or other agitating means which while the line is operating agitates the coating metal for keeping the alloying elements evenly distributed and for preventing the formation of the spangles (zinc crystals) in the case of galvanizing as the coating metal approaches the plastic state. When the line is stopped, the spiral or helical ribs serve as a dam restricting the leakage of the molten metal through the exit end of the splash tube. Immediately beyond the agitating means there are a series of longitudinal ribs which accurately center the work piece. The exit end of the splash tube has a smooth bore of gun barrel finish dimensioned to the coating thickness desired. The outer periphery of that portion of the splash tube extending outside the main housing is surrounded by an insulated manifold equipped with a heating means and a cooling means to accurately control the temperature of that portion of the splash tube. Therefore as the coated work piece reaches the exit end of the splash tube the coating metal has been cooled to the plastic state and the work piece leaves the splash tube with an accurately sized, stable coating. It is to be recognized however that the manifold containing the heating and cooling means for that portion of the splash tube extending outside of the housing, could be substituted by extending the length of that portion of the splash tube a sufficient amount to allow time for the metal to reach the plastic state through the effect of room temperature.

The present disclosure combines hot metallic coating with extruding in overcoming the stated problems. Thus, the only metal which leaves the coating means is the finished coating and therefore the entire system can be shielded within the inert atmosphere, as it becomes unnecessary to provide a means for collecting excess coating material.

The procedure for adding make-up metal to the bath, which formerly would have been to insert pigs into the open end of the galvanizing furnace, can be accomplished in the present invention by any number of means by one skilled in the art, such as by providing an inclined rectangular chute through the side wall of the furnace cover extending down into the bath. Such chute could be equipped with a sealing hinged cover for easy access and could also be kept under a seperate inert atmosphere. In this case, argon would be preferred due to the fact that it is heavier than air and would provide a continuous blanket over the section of the bath within the chute even while the hinged cover is open for the addition of the make-up metal.

BRIEF DESCRIPTION OF THE DRAWINGS

These and other advantages of the present invention will become more apparent from the following detailed description when read in conjunction with the accompanying drawings wherein.

DESCRIPTION OF THE PREFERRED EMBODIMENTS

Figure 1:
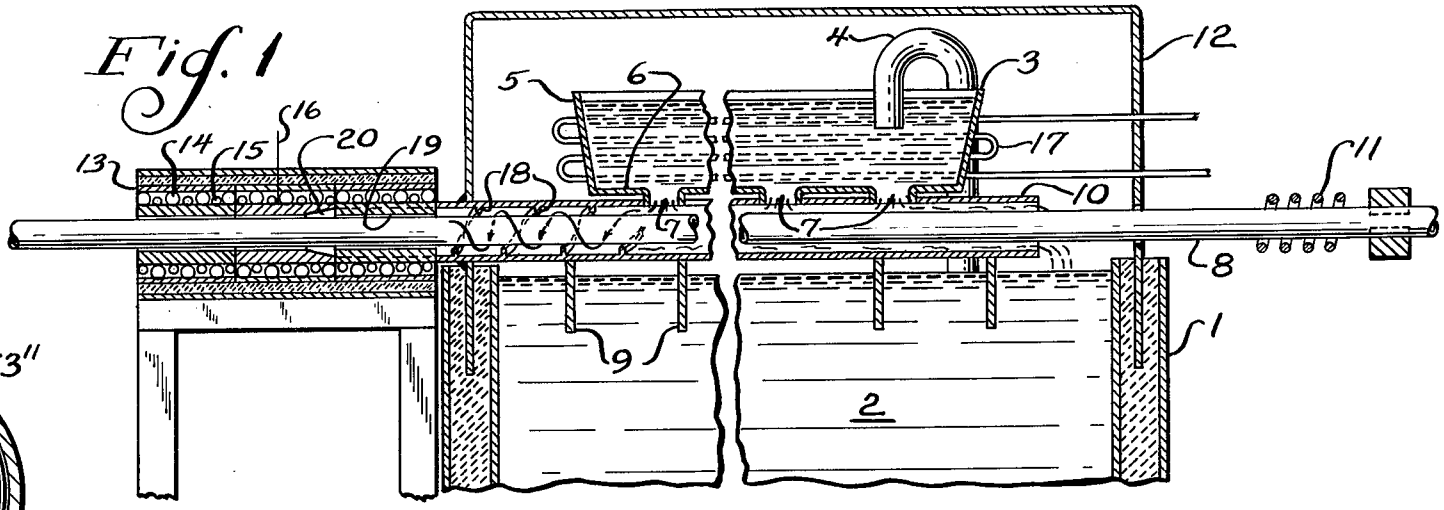
FIG. 1 is a schematic sectional and side elevational view of a tube coating plant conforming to the present invention.

In the embodiment shown in FIG. 1, a molten metal furnace 1 has in it the molten coating fluid 2 which is pumped by any convenient pumping device to the reservoir 3 through the pipe 4.

The reservoir comprises walls 5 at the sides and ends and a bottom 6 which has in it a series of apertures 7 through which molten material flows onto the tube 8, which forms the work piece in this case. The tube 8 passes through the unit from right to left as shown in FIG. 1 and is surrounded by a splash tube 10 which has spaced openings at the top so that the molten metal from the reservoir can flow into the splash tube through slots 7 and is then guided around the tube 8 by the splash tube 10.

It will be noted that the right hand end of the splash tube is unobstructed, whereby molten metal flow can be controlled by the size and positioning of the apertures 7 and also by the proximity of the splash tube to the tube 8 being treated.

As shown in FIG. 1, the level of molten coating metal in the furnace should be as close as practical to the underside of the splash tube to maintain the splash tube hot and thereby prevent chilling and freezing of the molten metal in contact with the splash tube. In this connection, heat exchangers such as the plates 9, can be extended from the splash tube into the body of molten metal in the galvanizing furnace.

A preheating induction coil 11 is shown surrounding the tube 8 as it enters the coating area, this being general practice as it is necessary to raise the tube 8 to a selected temperature to ensure correct coating.

As the coating is preferably carried out in an inert atmosphere, a cover 12 encloses the space above the molten metal furnace 1, including the reservoir and the entire coating area. Heater elements 17 surround the reservoir 3 to maintain the molten coating metal at the required temperature.

Figure 2:
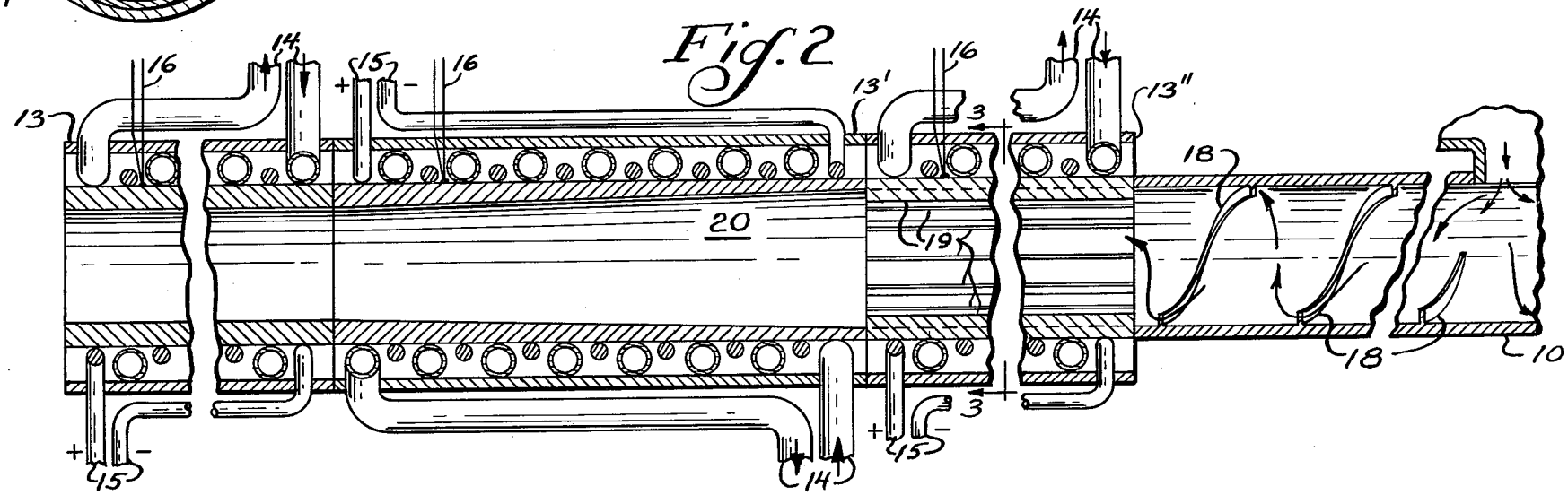
FIG. 2 is an exploded top sectional view of FIG. 1 of the present invention, showing the agitating means, centering means and temperature control means.

As further shown in FIGS. 1 and 2 that portion of splash tube 10 which extends outside cover 12 is surrounded by an insulated manifold 13, which contains cooling means 14 and heating means 15 providing close temperature control over the entire section of the splash tube which is outside cover 12. Heat sensing thermocouples 16 monitor the temperature along the length of the exposed portion of the splash tube.

Figure 3:
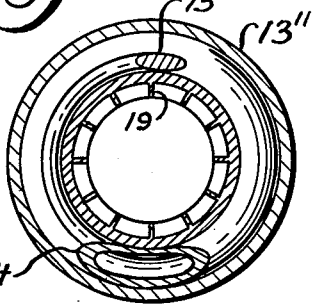
FIG. 3 is a sectional view, taken along the lines 3—3 of FIG. 2.

As shown in FIG. 2 the splash tube contains a series of spiral or helical ribs 18 which agitate (as indicated by the arrows at the right hand end of FIG. 2) the coating metal as it approaches the plastic state for keeping the alloying elements evenly distributed and for preventing the formation of spangles in the case of galvanizing. These spiral ribs 18 also prevent excess leakage of the molten coating fluid through the exit end of the splash tube when the line is stopped. Means other than ribs may of course be used for agitation. Longitudinal ribs 19 serve as guides to center the work piece thereby ensuring an evenly distributed coating on the work piece as it passes through the exit end 20 of the splash tube. The exit end 20 of the splash tube has converging walls toward the final exit opening of the splash tube. FIG. 3 shows a sectional view of the exit end 20 which has a smooth bore with a gun barrel finish, accurately dimensioned to the desired coating thickness. Thus for a given size tube 8 the thickness of the galvanized coating will be determined by the inside diameter of the left hand end, as viewed in FIG. 2, of exit end 20.

Figure 4:
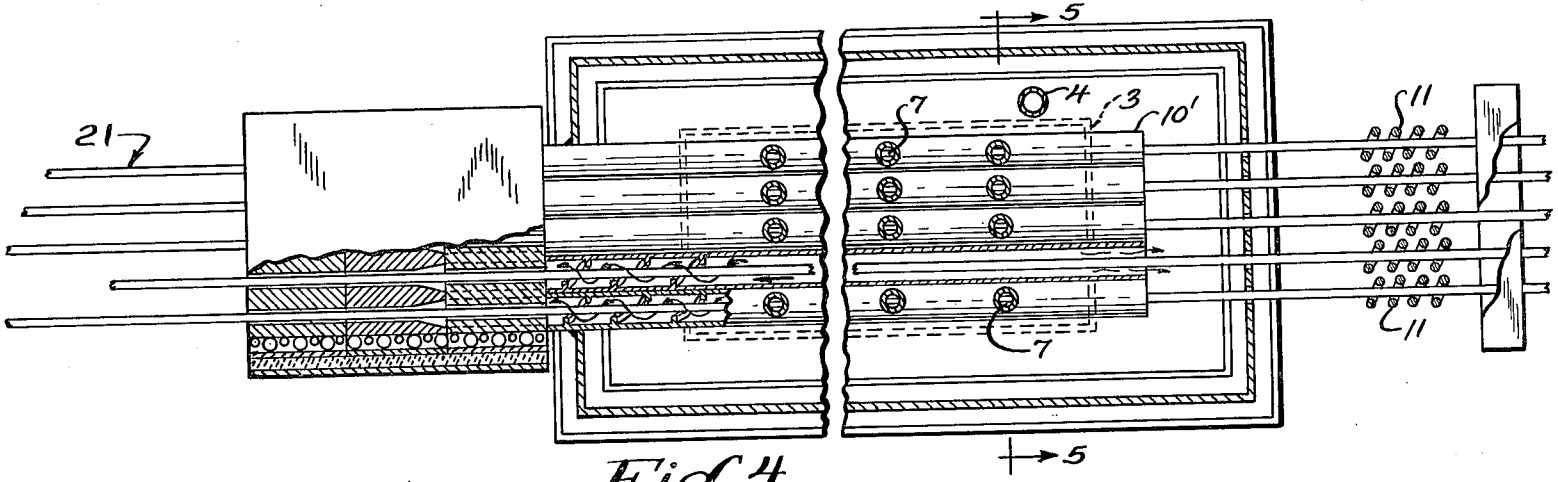
FIG. 4 is a top plan view of a second embodiment of the present invention.
Figure 5:
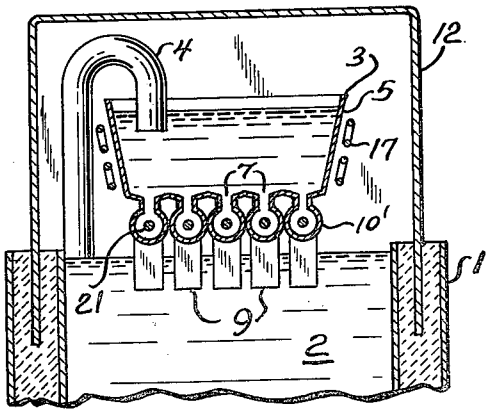
FIG. 5 is a sectionalized and side elevational view taken along the lines 5—5 of FIG. 4.

A further embodiment of the present invention is shown in FIGS. 4 and 5. FIG. 4 is a top plan view of the upper section of a multiple strand continuous wire or rod coating plant conforming to the present invention. FIG. 5 is a sectionalized, side elevational view of FIG. 4. As the diameter range of coated wire or rod 21 is normally well below 1", it is possible to attach several splash tubes 10' to the upper reservoir and have a multiple strand operation. It will be necessary however for each strand to have an individual pre-heat coil 11 and splash tube 10'. Except for these differences, the operation of the two embodiments are exactly the same and the reference designation of like parts are shown with the same numerals.

Figure 6:
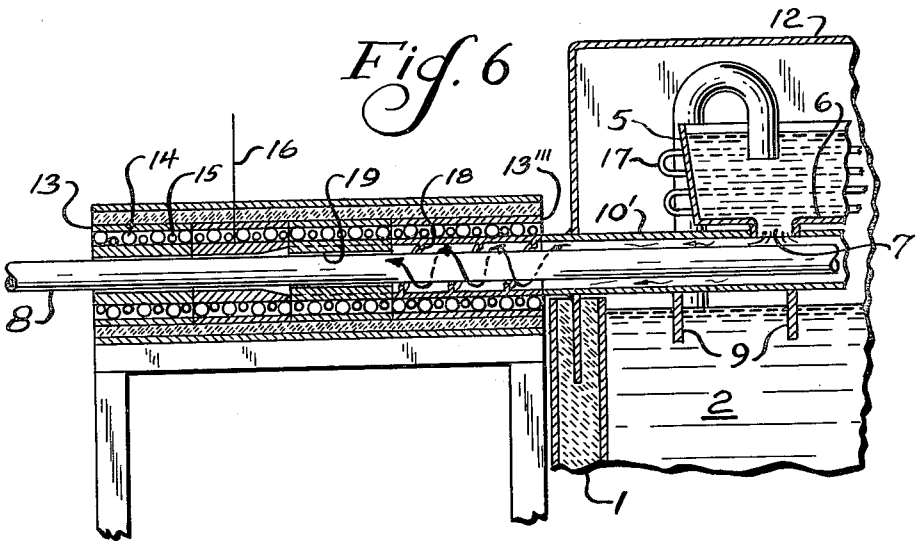
FIG. 6 is a sectionalized and side elevational view of a third embodiment of the present invention.

FIG. 6 shows a further modification of FIG. 1. Here, the series of spiral or helical ribs 18 are located within the insulated manifold 13, which is placed outside of the cover 12, and are positioned within the heating means 15 and cooling means 14. These modifications provide close temperature control of the coating metal during agitation. A further advantage is realized when it becomes necessary to change the line to a different diameter work piece or tube. With the modifications as shown in FIG. 6, it is not necessary to change the complete splash tube for every diameter change, but only to change the manifold to one specifically sized to the new diameter. However, with a radial diameter change, for example, from 2½ inches OD to ½ inch OD it would be necessary to change both the manifold and the splash tube, as the larger splash tube would result in an excessive load on the pump due to large volume leakage of the molten metal at the open right hand end of the splash tube, as viewed in FIG. 1.

According to the disclosure in my earlier U.S. Pat. No. 3,956,537, the work piece after exiting the splash tube passed through a circular die of non-corrodible material, a ceramic for example, located outside the cover to smooth the coating, to wipe globules and to assure among other things a coating of the desired thickness. The work piece was then passed through an air knife which removed excess galvanizing fluid and concurrently froze the remainder. The problem of coating sag through the force of gravity was greatly reduced as it was possible to vary the length of the splash tube and the relative distances between the exit end of the splash tube, the circular die and the air knife in allowing the coating to approach the plastic state. The excess coating fluid from the circular die, the air knife, and the exit end of the splash tube, fell back into the main supply. The molten metal flowing through the splash tube filled the annular space between the splash tube and work piece preventing the escape of the inert atmosphere through the splash tube.

In the present disclosure as the tubing or work piece passes through the splash tube, it is coated with the coating fluid; then as the coating is being progressively cooled to a stable plastic state, the coating is agitated within the splash tube for keeping the alloying elements evenly distributed and for preventing the formation of spangles in the case of galvanizing. The tubing or work piece then passes through a series of longitudinal ribs or other means which accurately center the tubing or work piece for final sizing and cooling in the exit section of the splash tube. The tubing or work piece exits the splash tube with an accurately sized coating in a stable condition so as not to be subject to sagging through the force of gravity.

The present disclosure may therefore best be described as a combination hot metallic coating and semi-hot extrusion process.

From the foregoing description of the method embodying the present invention, it can be seen that there has been eliminated the need for the air knife and circular die. Further, the problems of the coating sag and exposure of the excess coating fluid to the air have been overcome. In addition, it is now possible to completely enclose the entire system in an inert atmosphere thereby virtually eliminating the formation of dross and oxides.

The method of controlling the cooling of the splash tube to allow the coating to reach the plastic state and exit from the housing in a stable condition is achieved through the utilization of spiral or helical ribs for agitating the coating to keep the alloying elements evenly distributed and for preventing the formation of spangles in the case of galvanizing. When the line is not in operation, the spiral or helical ribs further serve to retard leakage from the exit end of the splash tube. Furthermore, the instant method centers accurately the work piece via longitudinal ribs while still allowing the coating material to pass therethrough. Additionally, the exit end of the splash tube has a smooth bore accurately dimensioned in order to accurately extrude a sized coating in the plastic stable state and to provide an even coating of the desired thickness about the periphery of the tubing or work piece.

The process of the instant invention is carried out in an inert atmosphere so that no molten metal leaves the enclosure.

While there has been illustrated and described what is at present thought to be the preferred embodiments of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiments disclosed as the best modes contemplated for carrying out this invention, but that the invention will include all embodiments falling within the scope of the appended claims.

What is claimed is:

1. A method of providing a uniform metallic coating on a moving work piece, comprising the steps of:

moving a said workpiece in a fixed path, including passage through a splash tube;

surrounding the work piece with molten metal during said movement;

containing the molten metal in close proximity to the work piece throughout its coating movement within the splash tube;

agitating progressively the contained molten metal with a series of spiral ribs positioned toward the exit end of the splash tube;

cooling the molten metal to approach a plastic state as it moves in the direction of work piece movement past the splash tube; and uniformily confining the thickness of the molten metal in its plastic state around the work piece as it cools to extrude a sized, stable coating on the work piece.

2. The method of claim 1, including providing an inert atmosphere in which the method is carried out so as to prevent the formation of oxides.

3. The method of claim 3, wherein the plastic state of the cooled metal effects damming of the molten coating metal upon stoppage of work movement.

4. The method of claim 1, including aligning the work piece to insure an evenly distributed coating about the outer periphery of the work piece.

5. The method of claim 1, including gradually constricting the thickness of the molten metal surrounding the work piece during said confining in the direction of work piece movement.

6. The method of claim 1, including smoothing the metallic coating on the work piece after the molten metal reaches its plastic state.

7. The method of claim 1, including surrounding and insulating the coated work piece and cooling and heating the metallic coating for controlling its temperature.

8. The method of claim 1 including gradually constricting and smoothing the metallic coating as it deposits on the work piece during said confining.

9. A method of providing a uniform metallic coating on a number of separate work pieces comprising the steps of:

heating the metal to provide a source of molten metal;

simultaneously moving the work pieces in separate paths including passage through a respective separate splash tube;

surrounding each work piece with molten metal from said source during said movement thereof;

containing the molten metal in close proximity to the work pieces throughout its coating movement within the respective splash tubes;

agitating pregressively the contained molten metal with a series of spiral ribs positioned toward the exit end of the splash tubes;

cooling the molten metal on the work pieces to approach a plastic state during movement of said workpieces past the splash tubes; and uniformly extruding and confining the cooled metal on the work pieces during said movement past the splash tubes to simultaneously produce a number of separate work pieces with uniform stable coatings.

* * * * *